United States Patent [19]

Buell

[11] 3,944,195

[45] Mar. 16, 1976

[54] APPARATUS FOR FEEDING GRANULAR MATERIAL TO A STEEL BATH

[76] Inventor: Eugene F. Buell, 301 Fifth Ave., Pittsburgh, Pa. 15222

[22] Filed: Sept. 19, 1974

[21] Appl. No.: 507,541

Related U.S. Application Data

[63] Continuation-in-part of Ser. No. 431,771, Jan. 8, 1974, abandoned, which is a continuation of Ser. No. 350,000, April 11, 1973, abandoned.

[52] U.S. Cl. ..... 266/34 A; 266/34 T; 75/53

[51] Int. Cl.[2] ..... C21C 7/00

[58] Field of Search ..... 75/51–58, 130–133.5, 75/129; 266/34 A, 34 T, 38, 42

[56] References Cited

UNITED STATES PATENTS

| | | | |
|---|---|---|---|
| 1,548,614 | 8/1925 | Konigsberg | 266/34 A |
| 2,290,961 | 7/1942 | Heuer | 75/53 |
| 2,781,260 | 2/1957 | Grandpierre | 266/34 A |

*Primary Examiner*—Gerald A. Dost
*Attorney, Agent, or Firm*—Buell, Blenko & Ziesenheim

[57] ABSTRACT

An apparatus is provided for introducing additive reactive agents of lower specific gravity than steel into a molten steel bath comprising a hollow cylindrical canister having an inner cylindrical arbor member and a spaced cylindrical outer wall connected to the inner arbor, means for introducing an additive agent into the hollow canister, at least one helical vane in the interior of the arbor member, said canister having at least a portion thereof separate from the inner arbor fusible in the molten steel bath to release the contents of the canister into the molten steel bath and means for rotating said canister and arbor member in the molten steel.

14 Claims, 6 Drawing Figures

Fig. 1.
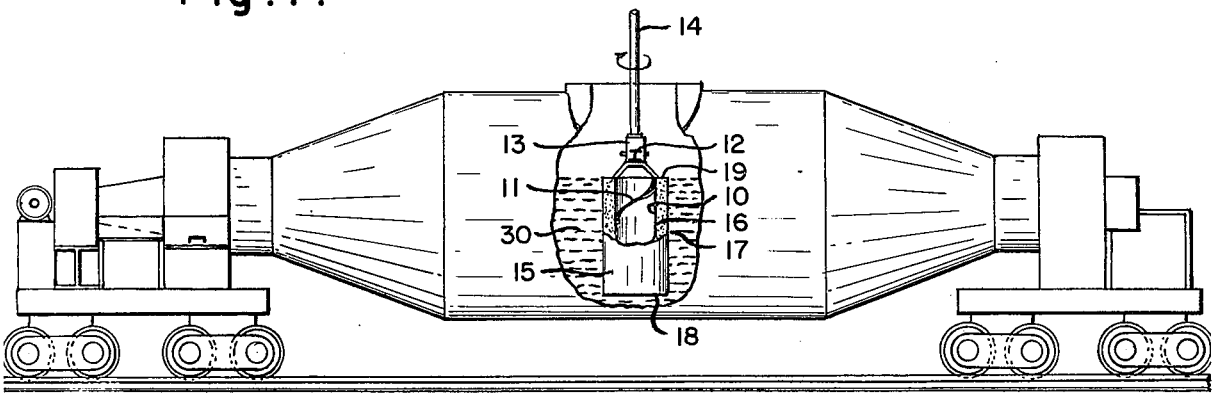
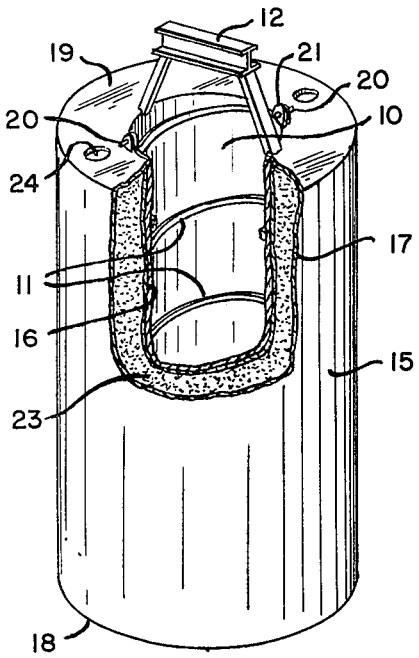
Fig. 2.
Fig. 3.
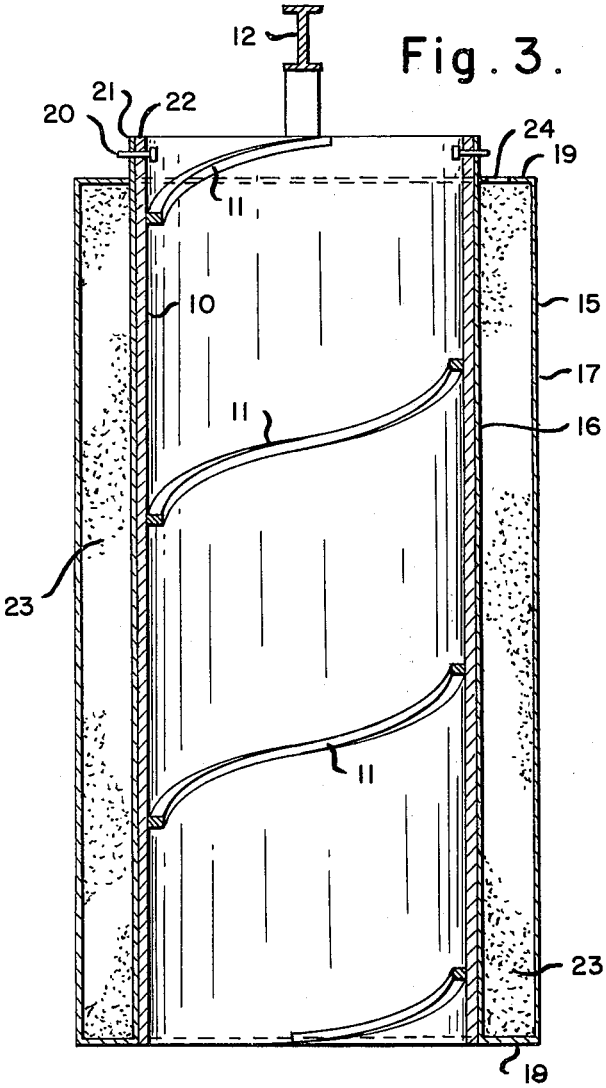

APPARATUS FOR FEEDING GRANULAR MATERIAL TO A STEEL BATH

This application is a continuation-in-part of my copending application Ser. No. 431,771 filed Jan. 8, 1974 now abandoned, which was in turn a continuation of Ser. No. 350,000 filed Apr. 11, 1973, now abandoned.

This invention relates to an apparatus for feeding granular materials to a steel bath and particularly to an apparatus for feeding materials which are highly reactive to the atmosphere either to the gases in the atmosphere or to the moisture in the atmosphere.

There are various granular additives which are highly desirable to be added to a steel bath which materials are readily reacted by components of the atmosphere and which are also difficult to add to a steel bath because of their specific gravity. An example of one of these materials is calcium carbide. Calcium carbide is much lighter than steel and if added to a molten steel bath will tend to float on top of the bath and to react in the slag rather than entering the steel bath. Calcium carbide is a highly desirable desulfurizing agent but it is difficult to add and difficult to keep because it is also readily reacted by moisture to form acetylene gas which destroys the calcium carbide and makes it totally useless as an additive. The present invention is directed to an apparatus for adding materials of this type particularly such as calcium carbide.

In a preferred embodiment of the apparatus of this invention there is provided a cylindrical hollow mandrel having internal helical vanes and a replaceable cylindrical canister made of thin walled steel which is filled with the granular material to be added to the melt and sealed. The canister is slid over the exterior of the mandrel and held in place either frictionally or by means of fastening devices. The mandrel and canister are inserted into the molten melt of steel and rotated so as to create a flow of steel out of the hollow center of the mandrel. This causes the canister to be melted and to release the calcium carbide into the moving steel, which in turn carries the calcium carbide throughout the body of the molten mass reacting it with sulfur to desulfurize the bath. The arbor may be made of heat resisting steel, cast iron or a refractory material or it may be made of steel coated with a refractory coating to assist in protecting it against the high temperatures of the molten steel so that the arbor may be used repeatedly with added canisters filled with calcium carbide. Alternatively, it would be possible to use the arbor as the inside wall of the canister and simply have a thin wall three sided canister which attaches to the arbor at top and bottom and is filled with the granular material to be introduced into the bath. Alternatively, the arbor may simply be a frame or spider carrying the helical vanes, which act as structural members of the framework, on the inside and a cannister outside.

In the foregoing general description certain objects, purposes and advantages of this invention have been set out. Other objects, advantages and purposes will be apparent from a consideration of the following description and the accompanying drawings in which:

FIG. 1 is a side elevational view of a submarine type steel vessel partly in section showing the manner in which the apparatus is used;

FIG. 2 is an isometric view of an apparatus according to the invention;

FIG. 3 is an enlarged section on the line III-III of FIG. 2;

Figure 4:
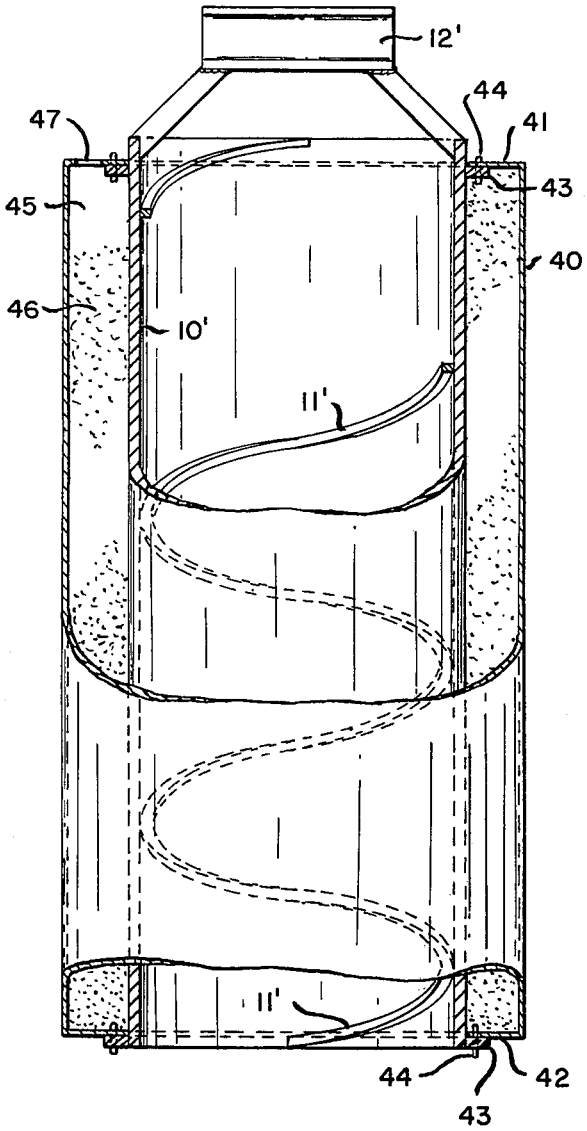
FIG. 4 is a section through a second embodiment of the invention.

Referring to the drawings and particularly to FIGS. 1–3 there is illustrated a presently preferred embodiment of the present invention. In these figures there is illustrated a hollow cylindrical arbor 10 having internal helical vanes 11 and a top cross member 12 which is engaged by a clamping head 13 on the end of a rotating shaft 14. A cylindrical canister 15 having inner 16 and outer 17 spaced cylindrical walls of thin steel connected by an annular bottom 18 and top 19 is slideable over the outside of arbor 10 and fastened by pins 20 through ears 21 on the top of the canister and ears 22 on top of the arbor. The canister 15 is filled with calcium carbide 23 through openings 24 in the annular 19 top which openings may be sealed at the place of filling for shipment or the canister may be filled where used. The assembly or arbor 10 and canister 15 filled with calcium carbide is inserted into a bath 30 to be treated and rotated by shaft 14. This causes the metal in the arbor core to be pushed downwardly and outwardly by the helical vanes 11. At the same time the thin steel walls of the canister 15 are melted by the heat of the molten steel and the calcium carbide is carried outwardly from the arbor with the moving metal to treat and desulfurize the entire molten body.

In FIG. 4 a second embodiment is illustrated using a central arbor 10' having helical vanes 11' and a cross member 12' as in FIGS. 1–3. A thin cylindrical outer wall 40 having inwardly projecting annular top 41 and bottom 42 flanges is attached to lugs 43 on the top and bottom of arbor 10' by pins 44 (or pop-rivets or any other suitable fastener, including welding). The hollow space 45 thus formed between the arbor 10' and wall 40 is filled with calcium carbide 46 through openings 47 in the top annulus 41.

The device is operated as in the case of FIGS. 1–3, with the outer wall 40 and top 41 and bottom 42 flanges being consumed thus releasing the calcium carbide into the bath.

Figure 5:
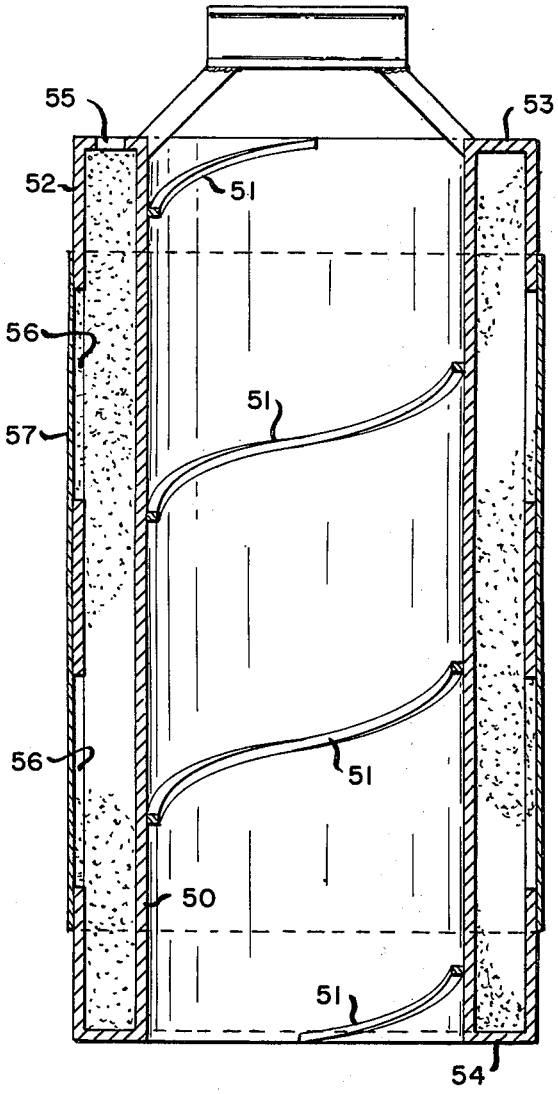
FIG. 5 is a section through a third embodiment of the invention.

Still another embodiment of the invention is illustrated in FIG. 5. In this embodiment a hollow cylindrical arbor portion 50 is provided with vanes 51. An outer cylindrical wall 52 is spaced from arbor portion 50 by annular ends 53 and 54 forming respectively a top and bottom for a hollow canister. The top end 53 is provided with openings 55 through which the interior of the canister can be filled with calcium carbide. The outer wall 52 is also provided with holes 56 which are covered by a wrapper of thin steel 57 held in place by bolting, riveting or otherwise fastening its ends together. The filled canister is used as in the case of FIGS. 1 and 4, except that here only the wrapper is consumed releasing the calcium carbide through the openings or holes 56 into the moving bath. The holes 56 may be designed to induce the molten steel to wash through the interior of the canister to aid in mixing the calcium carbide as well as in its removal from the canister.

Figure 6:
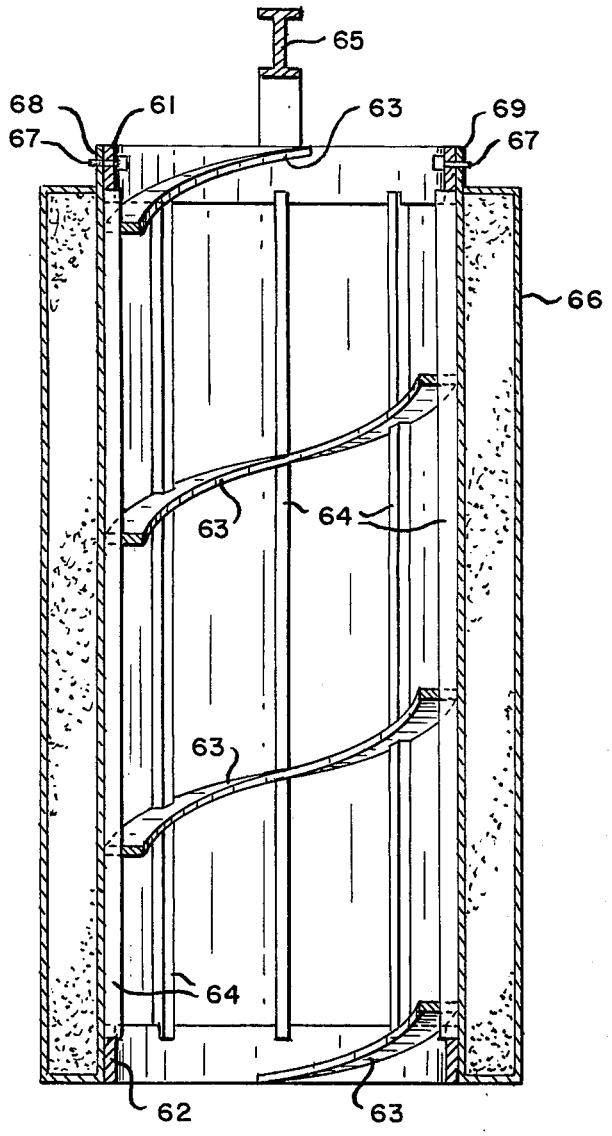
FIG. 6 is a section through a frame or spider embodiment of this invention.

In FIG. 6 I have illustrated a spider or frame made up of a top ring 61 and a bottom ring 62 with helical vanes 63 and vertical ribs 64 connecting them. The top ring has a cross member 65 as in FIG. 1. A canister 66 precisely as in FIG. 1 is attached to rings 61 and 62 by pins 67 as in FIG. 1 through ears 68 and 69.

While certain preferred practices and embodiments of this invention have been set out in the foregoing specification, it will be obvious to those skilled in the art that this invention may be otherwise embodied within the scope of the following claims.

I claim:

1. An apparatus for introducing additive reactive agents of lower specific gravity than steel into a molten steel bath comprising a hollow cylindrical canister having an inner cylindrical arbor member and a spaced cylindrical outer wall connected to the inner arbor, means for introducing an additive agent into the hollow canister, at least one helical vane in the interior of the arbor member, said canister having at least a portion thereof, separate from the inner arbor, fusible in the molten steel bath to release the contents of the canister into the molten steel bath and means for rotating said canister and arbor member in the molten steel.

2. An apparatus as claimed in claim 1 wherein the arbor member is of non-fusible material carrying a pair of spaced fusible cylindrical walls connected by fusible annuli and filled with additive agent, the inner of said walls being in sliding engagement with said arbor and fastened thereto for rotation with the arbor.

3. An apparatus as claimed in claim 1 wherein the arbor member is of non-fusible material carrying a spaced larger cylindrical wall connected to the arbor by fusible annuli, the area between the arbor member and wall being filled with additive agent.

4. An apparatus as claimed in claim 1 wherein the hollow clindrical canister is made of non-fusible material and the outer wall is provided with openings covered with a fusible layer.

5. An apparatus as claimed in claim 1 wherein the canister is filled with calcium carbide.

6. The apparatus as claimed in claim 1 wherein the cylindrical arbor member is made of heat and corrosion resisting steel.

7. The apparatus as claimed in claim 1 wherein the cylindrical arbor member is made of refractory material.

8. The apparatus as claimed in claim 1 wherein the cylindrical arbor member is made of cast iron.

9. An apparatus as claimed in claim 1 wherein the arbor is a pair of spaced rings connected by helical vanes, said rings having holding means for the canister.

10. An apparatus for introducing additive reactive agents of lower specific gravity than steel into a molten steel bath comprising a hollow canister having an inner wall defining an axial passage through the canister and a spaced outer wall connected to the inner wall and defining an enclosure for containing an additive agent, means for introducing an additive agent into the hollow canister, said canister having at least a portion thereof, separate from the inner wall, fusible in the molten steel bath to release the contents of the canister into the bath, stirring means connected to said canister and means for rotating said canister and stirring means in the molten steel.

11. An apparatus as claimed in claim 10 wherein the arbor is a pair of spaced rings connected by helical vanes, said rings having holding means for the canister.

12. The method of introducing an additive reactive agent of lower specific gravity than steel into a molten steel bath comprising the steps of:

a. filling a hollow cylindrical canister having an inner cylindrical arbor member having stirring means thereon with the agent to be added, said canister having at least a portion thereof fusible in the steel bath, b. inserting said canister into the molten steel bath to be treated while rotating the same, and c. continuously rotating the canister submerged in the steel bath until said fusible portion has melted and the additive agent is released to the bath and the bath has been stirred by the stirring means to mix the additive agent into the bath.

13. The method of claim 12 wherein the stirring means is at least one helical vane in the interior of the canister.

14. The method of introducing an additive reactive agent of lower specific gravity than steel into a molten steel bath comprising the steps of:

a. forming an elongated canister member containing said reactive agent having an axial passage therethrough, and stirring means thereon, and at least a portion fusible in said bath;

b. inserting said member into the molten steel bath to be treated while rotating the same; and c. continuously rotating the canister submerged in the steel bath until said fusible portion has melted and the additive agent is released to the bath and the bath has been stirred by the stirring means to mix the additive agent into the bath.

* * * * *